United States Patent [19]

Wooten

[11] 4,201,332

[45] May 6, 1980

[54] MAILING WRAPPER

[75] Inventor: Richard L. Wooten, St. Louis, Mo.

[73] Assignee: Moore Business Forms, Inc., Grand Island, N.Y.

[21] Appl. No.: 909,514

[22] Filed: Jun. 12, 1978

[51] Int. Cl.[2] ..... B65D 65/10; B65D 65/14; B65D 65/28

[52] U.S. Cl. ..... 229/92; 229/73

[58] Field of Search ..... 229/92, 40, 87 R, 73, 229/74; 282/22 R, 25, 11.5 A; 206/424

[56] References Cited

U.S. PATENT DOCUMENTS

| | | | |
|---|---|---|---|
| 673,285 | 4/1901 | Peddicord | 229/92 |
| 812,187 | 2/1906 | Mar | 229/92 |
| 881,011 | 3/1908 | Lambert | 229/92 |
| 1,283,680 | 11/1918 | Corcoran | 229/92 |
| 1,287,562 | 12/1918 | Young | 229/92 |
| 1,682,167 | 8/1928 | Deutschmeister | 229/92.1 |
| 2,330,619 | 9/1943 | Pomeranz | 229/87 |
| 2,723,078 | 11/1955 | Tilly | 229/92.8 |
| 2,874,892 | 2/1959 | Howard | 229/92.1 |
| 2,909,313 | 10/1959 | Maish | 229/92.8 |
| 3,093,296 | 6/1963 | Wood | 229/92.8 |
| 3,303,987 | 2/1967 | Caine | 229/92.8 |
| 3,380,644 | 4/1968 | D'Alessio | 206/424 |
| 3,981,435 | 9/1976 | Johnsen | 229/69 |
| 4,102,489 | 7/1978 | Lucas | 229/73 |

FOREIGN PATENT DOCUMENTS

| | | | |
|---|---|---|---|
| 1959284 | 1/1978 | Fed. Rep. of Germany | 229/87 R |
| 1431822 | 2/1966 | France | 229/92 |

*Primary Examiner*—Stephen P. Garbe

*Attorney, Agent, or Firm*—Allegretti, Newitt, Witcoff & McAndrews

[57] ABSTRACT

An improved two part mailing wrapper for magazines and the like is disclosed and includes a first, outer sheet adapted to be wrapped about the magazine during mailing and to have the name and address of the subscriber printed on its outer face. The improved mailing wrapper also includes a second, inner sheet which may be utilized to transmit subscriber personalized information, such as a subscription renewal order notice and a business reply envelope, to the subscriber of the magazine. The inner and outer sheets are constructed and arranged so that both the two part mailing wrapper and the magazine may be mailed at second class publication postal rates.

5 Claims, 10 Drawing Figures

MAILING WRAPPER

BACKGROUND AND SUMMARY OF THE INVENTION

The present invention relates to mailing wrappers for magazines and the like, and more particularly to an improved two part mailing wrapper which is adapted for use with mass circulation magazines and which includes information soliciting and facilitating the renewal of subscriptions for the magazines.

Traditionally, magazine publishers have realized a greater profit margin from the renewal of a subscription than from the original subscription. Consequently magazine publishers have, for a number of years, been seeking economical and effective methods to solicit subscribers to renew their subscriptions.

Today, as in the past, probably the most commonly accepted method of soliciting subscription renewals is to send the subscriber letters encouraging him to renew. The publisher begins sending solicitation letters to a subscriber at a pre-selected time prior to the expiration of the subscription and continues to send letters, at regular intervals, until a pre-selected time after the expiration of the subscription unless, of course, the subscriber renews in the interim. Generally each solicitation letter is different and each frequently contains enclosures, such as a renewal order form or notice and a business reply envelope, which are designed to make it as convenient as possible for the subscriber to renew.

However, while the solicitation letter method is presently thought to be one of the most effective methods of soliciting renewals, it has been estimated that an average of seven solicitation letters must be sent to a subscriber in order to induce him to renew his subscription. Thus, the cost of preparing and mailing a series of solicitation renewals is a relatively expensive method of soliciting renewals, and in recent years, has become even more expensive due, at least in part, to the increase in postal rates since each letter that is sent requires separate postage.

Insofar as I am personally aware, there have been no prior magazine mailing wrappers which have included subscription renewal information and which are capable of usage in connection with mass circulation magazines. In the past, however, it has been proposed that a mailing cover for a mail order catalog could be constructed so as to include a mailing card as a part of a fastening flap. The mailing card was designed to be detached by the recipient of the catalog and to be returned to the publisher. Such a mailing cover is disclosed in the U.S. Corcoran Pat. No. 1,283,680. It has also been suggested that a wrapping sheet for cylindrical packages could include a plurality of leaves which may contain directions or other information relative to the goods enclosed by the wrapping sheet and which remain intact after the wrapping sheet has been severed by means of a longitudinal severing strip. The U.S. Lambert Pat. No. 881,011 discloses such a wrapping sheet. However, neither the above mailing cover nor the above wrapping sheet could be utilized as a mailing wrapper for magazines that have to be mailed under the high speed conditions required for today's mass circulation magazines.

In the past, it has also been a relatively common practice for pieces of mail, and particularly for advertising mailing pieces, to include integral, but detachable, reply cards for the purpose of permitting convenient response to the mailing piece. Examples of such mailing pieces are disclosed in the U.S. Young Pat. No. 1,287,562; the U.S. Deutschmeister Pat. No. 1,682,167; the U.S. Pomeranz Pat. No. 2,330,619; the U.S. Tilly Pat. No. 2,723,078; the U.S. Howard Pat. No. 2,874,892; the U.S. Naish Pat. No. 2,909,313; the U.S. Wood Pat. No. 3,093,296; and the U.S. Caine Pat. No. 3,303,987. However, none of the foregoing, patented mailing pieces are capable of usage as a mailing wrapper for mass circulation magazines.

It is a primary object of the present invention to provide an improved mailing wrapper for magazines and the like, and particularly for mass circulation magazines, wherein subscription renewal information may be sent to the magazine subscriber with the magazine but without requiring the payment of any additional postage. A related object of the present invention is to provide an improved mailing wrapper of the type described wherein the wrapper includes a first outer sheet adapted to be wrapped about the magazine during mailing and a second inner sheet which may be utilized to transmit subscription renewal information, such as a subscription renewal order notice and a business reply envelope, to the subscriber of the magazine. Still another object of the present invention is to provide an improved mailing wrapper of the type described wherein the subscription renewal information is detachably secured to the cover of the magazine so that the subscription renewal information will be positioned to readily catch the attention of the subscriber when the mailing wrapper is removed from about the magazine.

More specifically, the improved two part mailing wrapper of the present invention is adapted to be quickly and easily wrapped about a magazine such that it can be used with mass circulation magazines and is also adapted to be utilized to transmit subscription renewal information, such as a subscription renewal order notice and a business reply envelope, to solicit and facilitate the renewal of the magazine subscription. This improved mailing wrapper includes a first outer sheet that is adapted to be wrapped about the magazine during mailing. This first sheet is generally rectangular in shape, and has a pre-selected length which is greater than the peripheral dimension of the magazine when the magazine is positioned for mailing. A first perforated line is formed in the first sheet and between the ends thereof. This first perforation line extends from one side edge of the first sheet to the other and permits the recipient of the magazine to manually and easily severe the first sheet along the first perforation line.

The improved mailing wrapper also includes a second, rectangular sheet which has a width no greater than the width of the first sheet and which has a pre-selected length that is less than the pre-selected length of the first sheet. A second perforation line is formed in the second sheet and between the ends thereof. One ends of the first and second sheets are secured together by means of a permanent glue or adhesive so that these one ends are substantially aligned and so that the first sheet overlies the second sheet. The portion of the second sheet, remote from the one end of the second sheet, includes subscription renewal information and is not secured to the first sheet.

When the improved wrapper of the present invention is wrapped about a magazine for mailing, the second sheet is disposed adjacent to the magazine, with the first sheet forming an outer cover for both the magazine and the second sheet such that the second sheet is not visible to a person looking at the magazine. The second sheet is positioned, with respect to the magazine, so that the portion of the second sheet containing the subscription renewal information overlies a part of the cover of the magazine. A line of fugutive glue is used to detachably secure that portion of the second sheet to the cover of the magazine. The other end of the first sheet is folded about the magazine and is secured, by means of an adhesive, to the outer face of the first sheet, adjacent to the one end of the first sheet so that the second perforation line in the second sheet is disposed adjacent to the first perforation line and between the first perforation line and the one end of the first sheet.

As a result of the construction and arrangement of the improved mailing wrapper of the present invention, when the subscriber or recipient of the magazine severes the first sheet along the first perforation line, the subscription renewal information, printed on the second sheet, will become immediately visible as the severed portions of the first sheet are separated. If the subscriber is interested in the subscription renewal information, the portion of the second sheet containing this information may be severed from the remainder of the second sheet, which is temporarily secured to the cover of the magazine, by tearing the second sheet along the second perforation line. Since the second sheet is attached to the magazine by fugitive glue, the second sheet can be readily detached from the magazine cover before or after the subscription renewal information portion thereof has been severed.

To facilitate the severence of the first sheet, a notch may be die cut in the first sheet adjacent to an end of the first perforation line. Also, the first and second sheets may be made from different and contrasting colored papers, and additional subscription renewal information may be printed on the inside face of the first sheet, adjacent to the first perforation line, to assist in the solicitation of the magazine subscription renewal. Furthermore, regularly spaced, machine feed apertures may be formed along at least the one ends of the first and second sheets so that the first and second sheets may be processed in conventional forms handling equipment thereby permitting the name and address of the subscriber to be printed on the outside face of the first sheet and on the second sheet prior to the first and second sheets being wrapped about the magazine.

As noted above, the improved mailing wrapper of the present invention is constructed and arranged so that a magazine and the improved wrapper may still be permitted to be mailed at second class publication postal rates, i.e. mailed at the same postal rate as the magazine would be mailed with a conventional, single sheet wrapper. This is obviously an important advantage, from a standpoint of commercializing the invention, since subscription renewal information can be sent to a subscriber at no additional mailing cost. Moreover, as a consequence of the usage of the improved mailing wrapper of the present invention, the subscription renewal information is positioned, with respect to the magazine, so that the subscriber will assuredly see the same when he removes the wrapper from about the magazine. Market tests have demonstrated that the improved mailing wrapper of the present invention is quite effective in securing the prompt renewal of the magazine subscriptions. Thus the usage of this improved mailing wrapper would appear to provide a magazine publisher with significant advantages over the prior magazine mailing wrappers and prior methods of soliciting subscription renewals.

These and other objects and advantages of the present invention will become apparent from the following description of the preferred embodiment of this invention, described in connection with the accompanying drawings.

Figure 1:
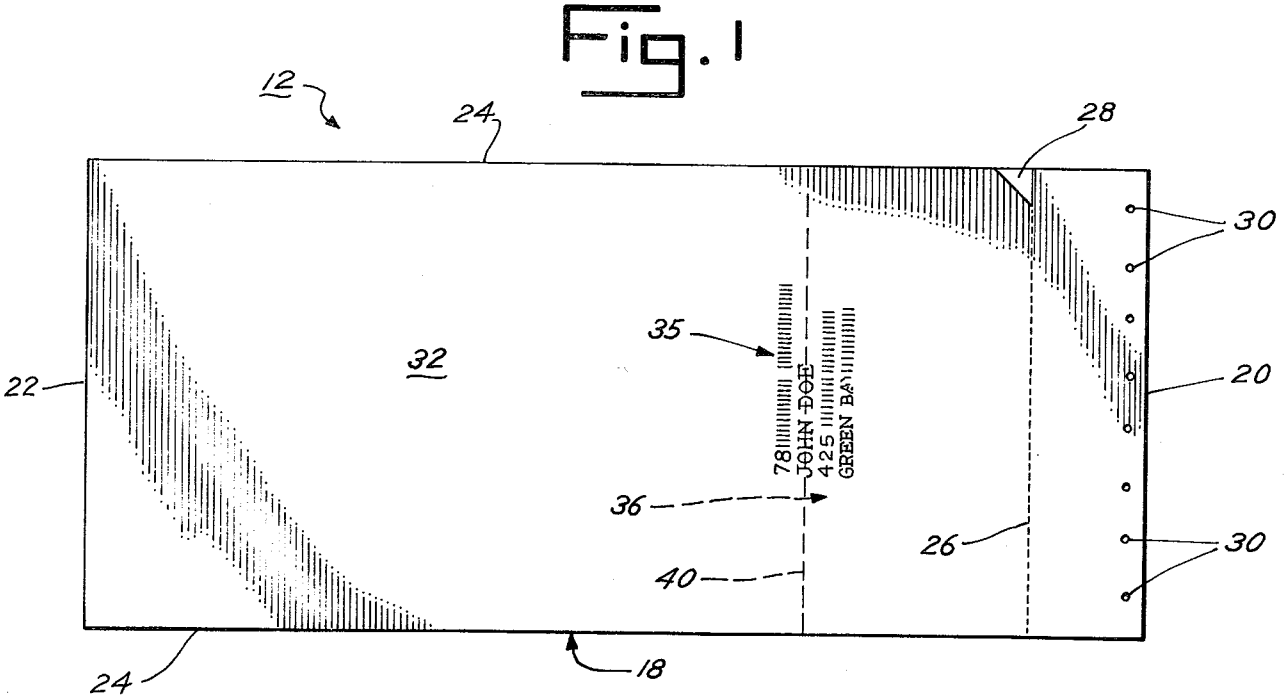
FIG. 1 is a plan view of the outer face of the improved mailing wrapper of the present invention.
Figure 6:
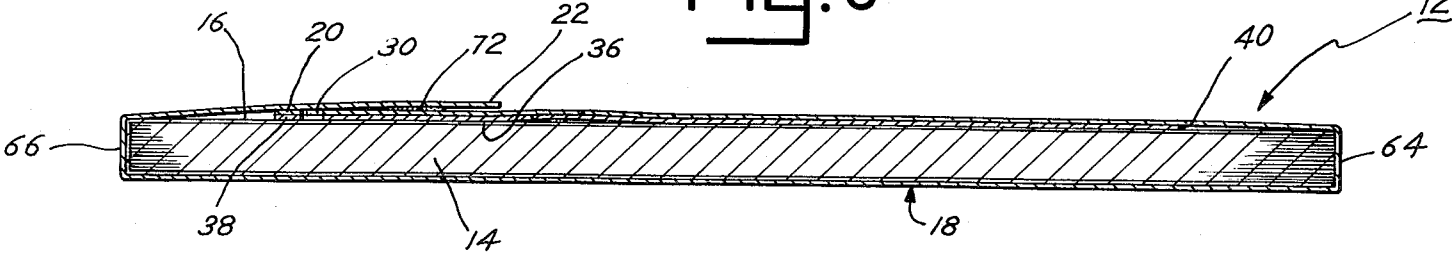
FIG. 6 is an enlarged view, similar to that shown in FIG. 5, showing the improved mailing wrapper and a magazine in condition for mailing.

Throughout the various figures of the drawings, the same reference numerals will be used to designate the same parts. Moreover, when the terms "right", "left", "right end", "left end", "inner" and "outer", are used herein, it is to be understood that these terms have reference to the structure shown in the drawings as it would appear to a person viewing the drawings.

DESCRIPTION OF THE PREFERRED EMBODIMENT

Figure 2:
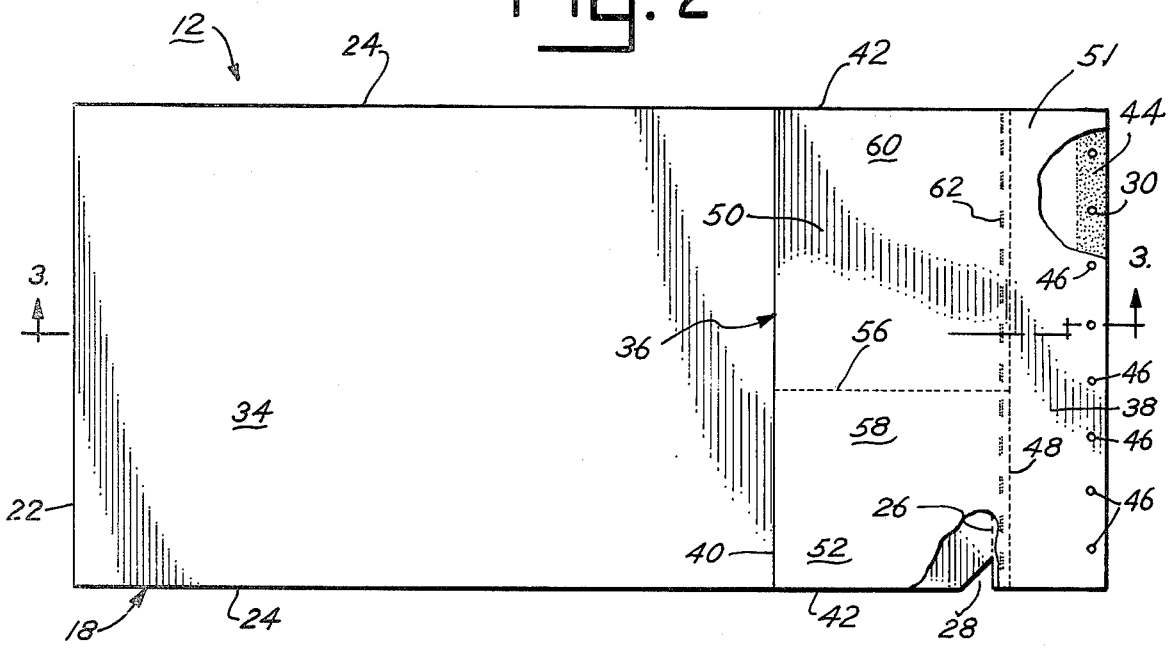
FIG. 2 is a plan view of the inside face of the improved mailing wrapper of the present invention.

Referring now to FIGS. 1 and 2, the improved mailing wrapper of the present invention is shown generally at 12 and is constructed so that it may be wrapped about a magazine 14 during the shipment of the magazine through the mails. The magazine 14, having a front cover 16, is of conventional construction and as shown in FIGS. 3–10, has a generally rectangular shape.

The mailing wrapper 12 includes a first, outer, rectangular sheet 18 which has a first end 20, a second end 22 and side edges 24. The length of the sheet 18, i.e. the distance between its ends 20 and 22, is preselected so as to enable the wrapper to be wrapped completely about the magazine 14 when the magazine is positioned for mailing, such as shown in FIGS. 3–10. The width of the outer sheet 18, i.e. the distance between its side edges 24, is less than the height of the magazine 14. The inner sheet 18 may be made from a relatively heavy-duty paper, such as 70 lb. kraft paper, which may be colored the conventional brown shade normally associated with kraft paper.

A first perforation line 26 is formed in the outer sheet 18 between its ends 20 and 22, but more closely adjacent the first end 20. The perforation line 26 extends from one side edge 24 of the outer sheet 18 to the other and is constructed so that the outer sheet 18 may be readily, manually severed along the line 26 by the subscriber or recipient of the magazine 14. To facilitate severence of the outer sheet 18 along the perforation line 26, a small, triangular piece of the outer sheet 18, indicated generally at 28, is die-cut from the sheet 18, adjacent to the perforation line 26 and a side edge 24.

Figure 3:
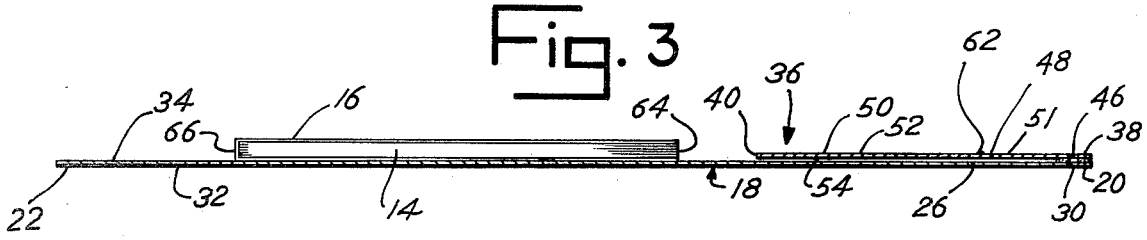
FIG. 3 is a cross-sectional view taken along the line 3—3 in FIG. 2 and with the improved mailing wrapper being shown positioned adjacent to a magazine.

The outer sheet 18 may also include a plurality of regularly spaced, aligned feed apertures 30 disposed adjacent one or both of its ends 20 and 22, although the apertures 30 are only shown along the first end 20 in the outer sheet 18 in FIGS. 1 and 3. These feed apertures 30 are adapted to be engaged by the teeth of a tractor or similar mechanism utilized in conventional form handling equipment. The inclusion of these feed apertures 30 enables a publisher to print information, including subscriber personalized information, on the outer and inner faces 32 and 34 of the sheet 18 at high speeds by means of a computer controlled printer. For example, the name and the address of the subscriber to whom the magazine 14 is to be sent can be printed on the outer face 32 of the sheet 18, such as generally indicated at 35. Under present postal regulations, however, no other information may be printed on the outer face 32 of the sheet 18, except instructions with respect to opening the wrapper 12, and these instructions may be conveniently printed adjacent to the die cut piece 28 and to the perforation line 26.

The improved mailing wrapper 12 also includes a second, inner, rectangular sheet 36 which has a first end 38, a second end 40, and side edges 42. The inner sheet 36, has a pre-selected length, i.e. a distance between its ends 38 and 40, which is less than the pre-selected length of the outer sheet 18 and which is no greater than the width of the front cover 16 of the magazine 14. The width of the inner sheet 36, i.e. the distance between its side edges 42, is equal to the width of the outer sheet 18. The inner sheet 36 may be made from a lighter paper than the outer sheet 18, such as for example, 50 lb. offset paper, which may be colored white or a lighter contrasting color to the color of the outer sheet 18. This contrast in colors assists in making sure that the subscriber opens the wrapper 12 along the perforation line 26 since the contrasting color of the inner sheet is visible to the subscriber through the cut-out piece 28 and, thus, highlights the perforation line 26.

The first end 38 of the inner sheet 36 is aligned with the first end 20 of the outer sheet 18, and the two first ends 38 and 20 are permanently secured together by a strip of conventional adhesive or glue, such as generally indicated at 44 in FIG. 2. A plurality of regularly spaced feed apertures 46 are formed in the first end 38 of the inner sheet 36 and are aligned with the feed apertures 30 in the outer sheet.

As best shown in FIGS. 2 and 3, the second end 40 of the inner sheet 36 is disposed between the first and second ends 20 and 22 of the outer sheet 18 and between the perforation line 26 and the second end 22 of the outer sheet. The portion of the inner sheet 36 remote from the first end 38 may be moved relative to the outer sheet 18 although in normal usage, i.e. when the wrapper 12 is wrapped about the magazine 14, the planes of the first and second sheets 18 and 36 are substantially parallel.

As best illustrated in FIG. 2, a perforation line 48 is formed in the inner sheet 36 between its ends 38 and 40 and extends from one side edge 42 to the other. When the outer and inner sheets 18 and 36 are disposed about the magazine 14, in a parallel plane relationship such as shown in FIGS. 2 and 3, the perforation line 48 is positioned between the perforation line 26 and the first ends 20 and 38 of the outer and inner sheets and closely adjacent to the perforation line 26. The perforation line 48 permits separation of the distal portion 50 of the second sheet 36, i.e. the portion disposed between the perforation line 48 and the second end 40, from the fixed portion 51 of the second sheet 36, i.e. from the portion of the second sheet between the first end 38 of the inner sheet and the perforation line 48. This distal portion 50 of the inner sheet 36 may have subscription renewal information printed on both its inner and outer faces 52 and 54, respectively. A perforation line 56, which extends perpendicularly from the perforation line 48 to the second end 40 of the inner sheet 36, permits the portion 50 to be separated into two parts 58 and 60 as best illustrated in FIG. 2. More specifically, the part 58 may comprise a subscription renewal notice or form and the part 60 may comprise a business reply envelope designed for mailing the part 58 back to the publisher of the magazine.

Referring to FIGS. 2 and 3, a fugitive glue line 62 is disposed on the inner face 52 of the inner sheet 36 and extends from one side edge 42 to the other. The fugitive glue line is adapted to temporarily secure the inner sheet to the outer face of the front cover 16 of the magazine 14 when the mailing wrapper 12 is wrapped about the magazine. The strength of the fugitive glue in the glue line 62 is such that the inner sheet 36 may be readily, manually detached from the front cover 16 without destroying or marring the front cover or the inner sheet 36. The fugitive glue line 62 is disposed between the perforation lines 26 and 48 when the outer and inner sheets 18 and 36 are disposed in their parallel plane relationship as illustrated in FIG. 3.

Figure 4:
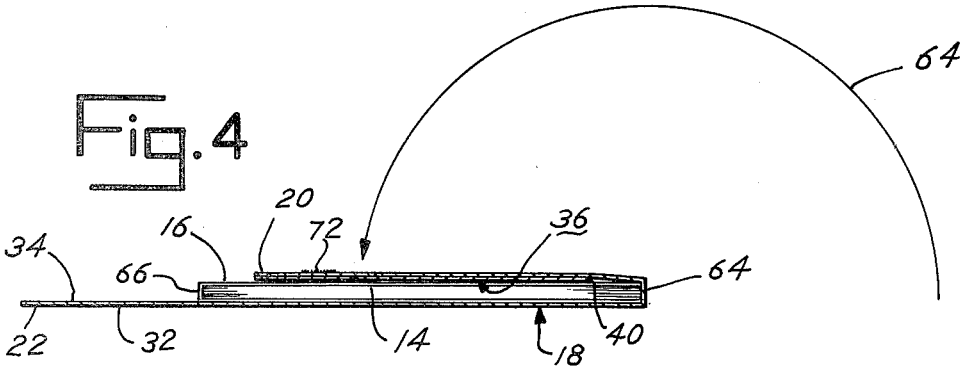
FIG. 4 is an end view, generally similar to FIG. 3, showing one end of the wrapper being wrapped about the magazine.
Figure 5:
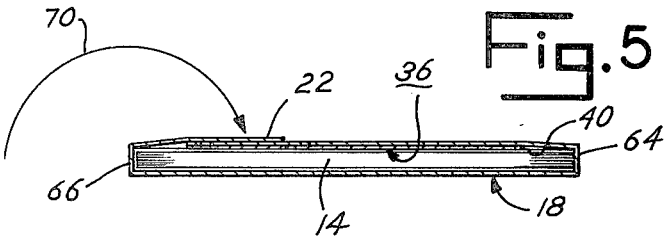
FIG. 5 is an end view, similar to that shown in FIG. 4, showing the other end of the wrapper being wrapped about the magazine.
Figure 7:
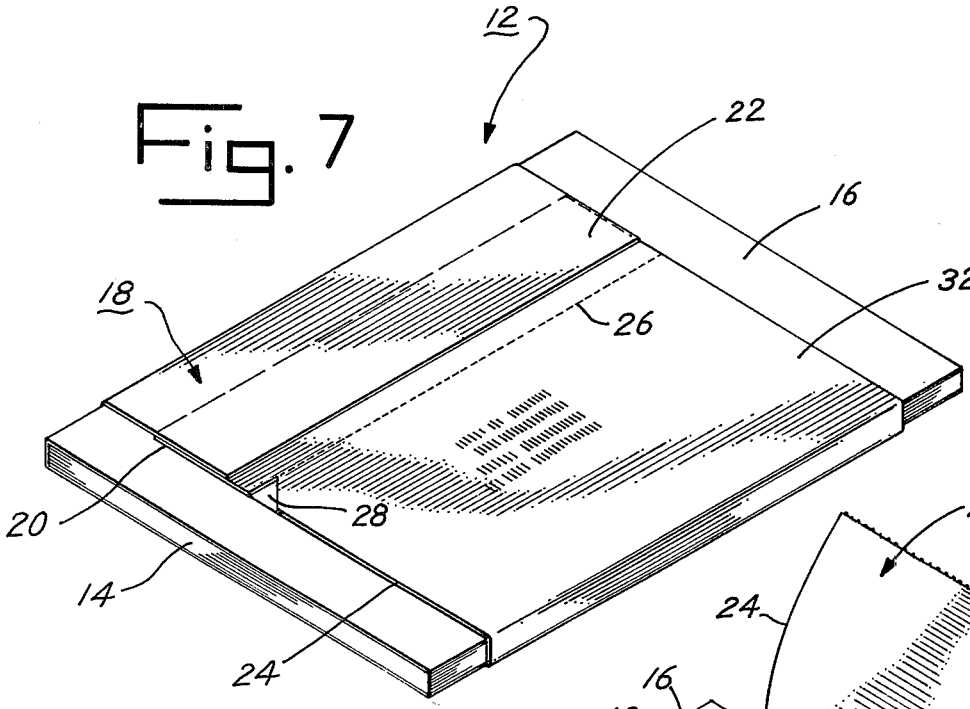
FIG. 7 is a perspective view of the improved mailing wrapper of the present invention shown wrapped about a magazine.

Referring now to FIGS. 3-6, the wrapper 12 is folded or wrapped about the magazine 14 as foflows: The magazine 14 is positioned on the inner face 34 of the outer sheet 18 intermediate the ends 20 and 22 of the sheet 18, with the front cover 16 of the magazine facing away from the wrapper 12. The first ends 20 and 38 of the outer and inner sheets 18 and 36, respectively, are folded, as indicated by the arrow 64 in FIG. 4, around the right side edge 66 of the magazine 14 and over the front cover 16 of the magazine 14 so that the inner face 52 of the inner sheet 36 is placed in surface to surface contact with the cover 16, so that the first ends 18 and 38 are spaced from the uncovered, left side edge 68 of the magazine and so that the second end 40 of the inner sheet 36 is spaced from the covered, right side edge 66 of the magazine. When the first ends 20 and 38 are folded, as shown in FIG. 4, the fugitive glue line 62 is brought into contact with the front cover 16 so as to detachably secure the inner sheet 36 to the front cover 16. As indicated by the arrow 70 in FIG. 5, the second end 22 is next folded around the left edge 66 of the magazine and over the front cover 16 and first ends 20 and 38 of the sheets 18 and 36. As best shown in FIG. 4, a strip 72 of permanent adhesive is applied to the outer face 32 of the outer sheet 18, between the side edges 24 and adjacent to its first end 20. When the second end 22 of the outer sheet 18 is brought into contact with this adhesive strip 72, as a result of the second end being folded around the edge 66 of the magazine 14, the adhesive strip 72 secures the second end 22 permanently to the outer face 32 of the outer sheet, and therefore, secures the mailing wrapper 12 about the magazine 14. As best shown in FIG. 7, when thus folded and secured, the second end 22 overlies the first ends 20 and 38 of the outer and inner sheets 18 and 36, respectively, so as to "hide" the feed apertures 30 and 46. Moreover, as noted above, the length of the outer sheet is selected so that when it is folded about the magazine 14, the second end 22 does not overlie the perforation line 26.

Figure 8:
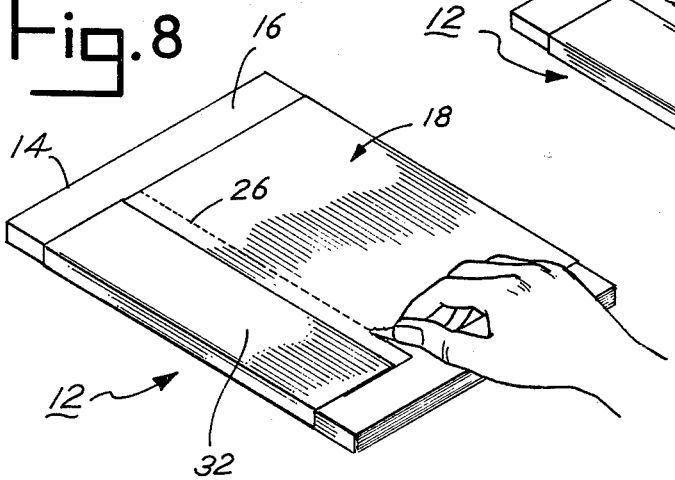
FIG. 8 is a perspective view, similar to that shown in FIG. 7, showing the improved mailing wrapper being severed along a first perforation line.
Figure 9:
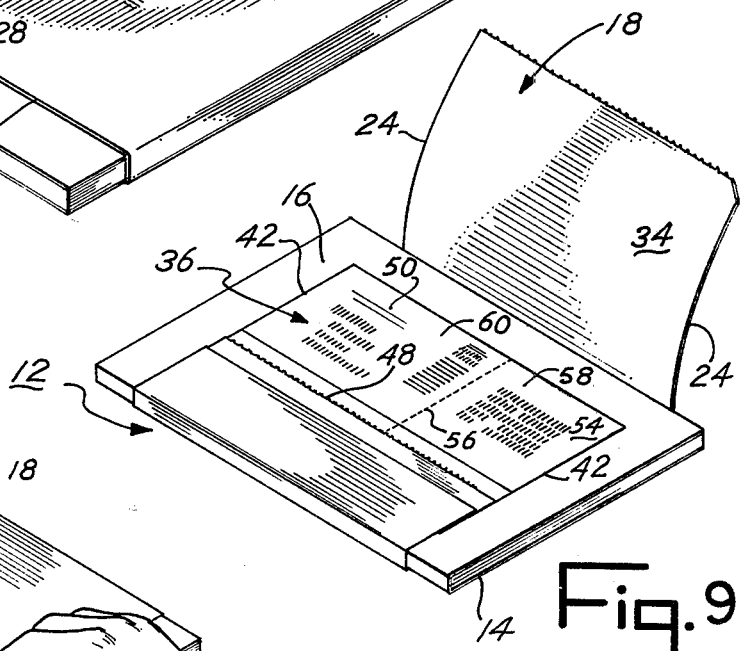
FIG. 9 is a perspective view, similar to that shown in FIGS. 7 and 8, showing the improved mailing wrapper being folded away after it has been severed along the first perforation line.
Figure 10:
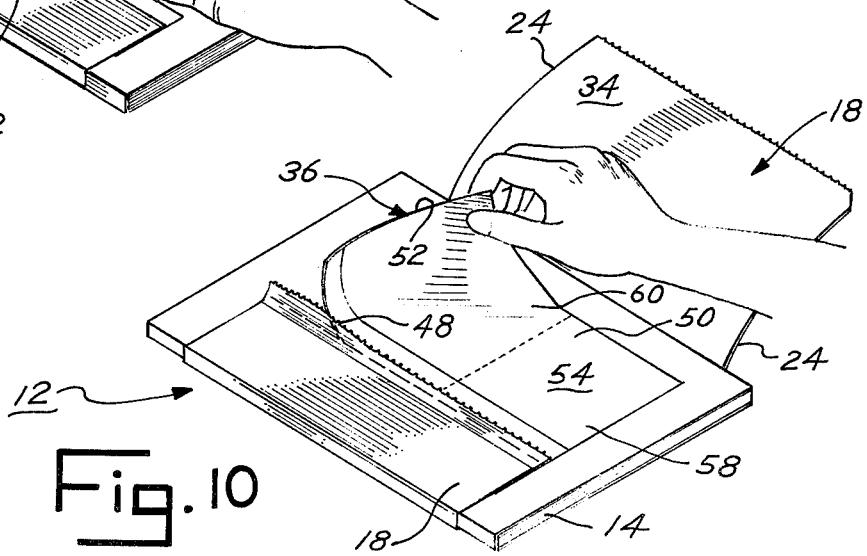
FIG. 10 is a perspective view, similar to that shown in FIGS. 7–9, showing the subscription renewal information portion of the improved mailing wrapper being severed from the remainder of the wrapper.

To remove the mailing wrapper 12 from about the magazine 14, the magazine and wrapper are disposed, as shown in FIG. 7, with the front cover 16 and the perforation line 26 facing upwardly. The person opening the mailing wrapper 12 grasps the outer sheet 18, adjacent to the cut-out piece 28, and pulls the right hand portion of the outer sheet upwardly with respect to the remaining left hand portion such as shown in FIG. 8. As stated before, the outer and inner sheets 18 and 36 may be made from contrastingly colored papers, as for example, the outer sheet may be brown in color while the inner sheet is white in color, so that the triangular piece 28 will be readily apparent to a person desiring to unwrap the magazine, and so as to facilitate the person locating the perforation line 26 and grasping the right hand portion of the sheet 18. After the outer sheet has been completely severed along the perforation line 26, the right hand portion of the outer sheet is folded away thereby exposing the outer face 54 of the inner sheet 36 so that the person severing the mailing wrapper sees the outer face 54 of the inner sheet and the subscription renewal information printed thereon. The inner surface of the right hand portion of the outer sheet may also include printed information which solicits renewal of the magazine subscription. If seeing this subscription renewal information induces the person to renew his subscription, he may then sever the portion 50 of the inner sheet 36 by grasping that portion 50 and separating it from the fixed portion 51 by tearing along the perforation line 48. The person may also conveniently separate the parts 58 and 60 of the portion 50 by tearing it along the perforation line 56. The person would then fill out any pertinent subscription renewal information called for by the part 58 and insert the part 58 in the business reply envelope 60.

In view of the foregoing, it is submitted that those having skill in this art will appreciate that the improved mailing wrapper 12 of the present invention not only provides a practical, satisfactory mailing wrapper for a magazine, but in addition affords a significant commercial advantage to a magazine publisher in that it permits subscription renewal information to be sent directly and economically to the magazine subscribers along with the magazine. Since all subscription renewal information is disposed within and is hidden by the outer sheet 18, the mailing wrapper magazine 12 may be mailed at second class publication postal rates, i.e. at the postal rates which magazines are normally mailed. The mailing wrapper 12 has the added important advantage that the subscription renewal information is positioned so that it will invariably be brought to the immediate attention of the subscriber when he unwraps the mailing wrapper.

Still another significant advantage of the improved mailing wrapper 12 is that its construction permits personalized subscriber information to be printed both on the outer face 32 of the outer sheet 18, but also on both the inner and outer faces 52 and 54 of the inner sheet 36. This certainly encourages a subscriber to act to renew his subscription.

It should also be apparent to those having skill in this art that modifications or changes could be made in the construction of the improved mailing wrapper 12 as described above. For example, more than one inner sheet could be included in the wrapper 12 and these additional sheets could contain additional subscription renewal information or other incentives for inducing the renewal of the subscription, such as, for example, coupons or the like. In addition, rather than including a business reply envelope, the inner sheet 36 could include a business reply card. Similarly, the inner and outer sheets 18 and 36 could be made from the same paper, although as noted above, preferably they should be made from different, contrasting colored papers. Those having skill in this art will further recognize that the improved mailing wrapper 12 could be used to wrap products, other than magazines, such as for example, books, mail order catalogs and the like.

Accordingly, since the invention disclosed herein may be embodied in other specific forms without departing from the spirit or central characteristics thereof, the preferred embodiment described hereinabove is therefore to be considered in all respects as illustrative and not restrictive, the scope of the invention being indicated by the appended claims, rather than by the foregoing description, and all changes which come within the meaning and range of equivalency of the claims are therefore intended to be embraced therein.

I claim:

1. An improved mailing wrapper which is adapted to be wrapped about a magazine and the like during the mailing thereof, which may also be utilized to transmit information, such as a subscription renewal order notice and a business reply envelope, to solicit and facilitate the renewal of the subscription of the magazine and which is constructed and arranged such that the improved mailing wrapper and the magazine may still be permitted to be mailed at second class publication postal rates, comprising:

a first sheet adapted to be wrapped about the magazine while the same is being sent through the mails, the first sheet having an inside face adapted to be disposed adjacent to the magazine when the first sheet is wrapped about the magazine, an outside face, a first end, a second end, side edges extending between the first and second ends, a pre-selected width, extending between the side edges, and a pre-selected length extending between the first and second ends, with the pre-selected length being greater than the peripheral dimension of the magazine when the magazine is positioned for mailing;

a first perforation line formed in the first sheet and extending from one side edge to the other side edge of the first sheet for permitting the recipient of the magazine to manually sever the first sheet along the first perforation line, the first perforation line being spaced from the first and second ends of the first sheet and being spaced more closely adjacent the first end than the second end;

a second sheet for providing information to the recipient of the mailed magazine, the second sheet having an inside face, an outside face, a first end, a second end, side edges extending between the first and second ends, a pre-selected width that is no greater than the pre-selected width of the first sheet, and a pre-selected length that is less than the peripheral dimension of the front cover of the magazine when the magazine is in position for mailing;

means for securing the first end of the second sheet to the first sheet between the first end of the first sheet and the first perforation line so that the first ends of the first and second sheets are substantially aligned, so that a portion of the second sheet, remote from the first end of the second sheet, may be moved, with respect to the first sheet, about the first end of the second sheet, so that the second sheet is disposed between the side edges of the first sheet, so that the inside face of the second sheet is adjacent to the magazine, so that the outside face of the second sheet is adjacent to the inside face of the first sheet, and so that the second end of the second sheet is spaced from the first ends of the first and second sheets and from the second end of the first sheet; and a second perforation line formed in the second sheet and extending from one side edge to the other side edge of the second sheet for permitting the recipient of the magazine to separate at least part of the portion of the second sheet from the first end of the second sheet, the second perforation line being disposed between the first perforation line and the first end of the second sheet when the first and second sheets are wrapped about the magazine and when the inside face of the first sheet and the outside face of the second sheet are disposed adjacent to each other.

2. A mailing wrapper which is adapted to be wrapped about a magazine and the like during the mailing thereof, which may also be utilized to transmit information, such as a subscription renewal order notice and a business reply envelope, to solicit and facilitate the renewal of the subscription of the magazine and which is constructed and arranged such that the improved mailing wrapper and the magazine may still be permitted to be mailed at second class publication postal rates, comprising:

a first sheet adapted to be wrapped about the magazine while the same is being sent through the mails, the first sheet having an inside face adapted to be disposed adjacent to the magazine when the first sheet is wrapped about the magazine, an outside face, a first end, a second end, side edges extending between the first and second ends, a pre-selected width extending between the side edges, and a pre-selected length extending between the first and second ends, with the pre-selected length being greater than the peripheral dimension of the magazine when the magazine is positioned for mailing;

a first perforation line formed in the first sheet and extending from one side edge to the other side edge of the first sheet for permitting the recipient of the magazine to manually sever the first sheet along the first perforation line, the first perforation line being spaced from the first and second ends of the first sheet;

a second sheet for providing information to the recipient of the mailed magazine, the second sheet having an inside face, an outside face, a first end, a second end, side edges extending between the first and second ends, a pre-selected width that is no greater than the pre-selected width of the first sheet, and a pre-selected length that is less than the pre-selected length of the first sheet;

means for securing the first end of the second sheet to the first sheet between the first end of the first sheet and the first perforation line so that the first ends of the first and second sheets are substantially aligned, so that a portion of the second sheet, remote from the first end of the second sheet, may be moved, with respect to the first sheet, about the first end of the second sheet, so that the second sheet is disposed between the side edges of the first sheet, so that the inside face of the second sheet is adjacent to the magazine, so that the outside face of the second sheet is adjacent to the inside face of the first sheet, and so that the second end of the second sheet is spaced from the first ends of the first and second sheets and from the second end of the first sheet; and a second perforation line formed in the second sheet and extending from one side edge to the other side edge of the second sheet for permitting the recipient of the magazine to separate at least part of the portion of the second sheet from the first end of the second sheet, the second perforation line being disposed between the first perforation line and the first end of the second sheet when the first and second sheets are wrapped about the magazine and when the inside face of the first sheet and the outside face of the second sheet are disposed adjacent to each other;

the first end of the second sheet being secured to the first sheet adjacent to the first end of the first sheet so that the first end of the first sheet overlies and is aligned with the first end of the second sheet; and the second perforation line being spaced closer to the first perforation line than to the first end of the second sheet.

3. The improved mailing wrapper described in claim 1 or 2 including means for securing the second end of the first sheet to the outside face of the first sheet between the first end of the first sheet and the first perforation line when the first sheet is wrapped about the magazine.

4. The improved mailing wrapped described in claim 1 or 2 wherein the inside face of the second sheet is positioned adjacent to and overlies at least a part of the front cover of the magazine when the first and second sheets are wrapped about the magazine; wherein the inside face of the second sheet includes means for removably attaching the second sheet to the part of the cover of the magazine wherein the removably attaching means comprises a fugitive glue line; and wherein the fugitive glue line is on the inside face of the second sheet and is disposed between the first and second perforation lines when the first and second sheets are wrapped about the magazines.

5. The improved mailing wrapper described in claim 1 or 2 wherein the portion of the second sheet includes a renewal order notice and a business reply envelope; wherein a third perforation line is formed in the second sheet and extends from the second perforation line to the second end of the second sheet so that the renewal order notice and business reply envelope can be separated from the first end of the second sheet by the recipient of the magazine and so that the renewal order notice can be separated from the business reply envelope.

* * * * *